US005150869A

United States Patent [19]

Gould et al.

[11] Patent Number: 5,150,869

[45] Date of Patent: Sep. 29, 1992

[54] MULTI-FUNCTIONAL COASTER

[75] Inventors: Murray J. Gould, Gaithersburg; Joshua L. Kohn, Owings Mills; Matthew O. Kohn, Baltimore, all of Md.

[73] Assignee: Longacre & White, Arlington, Va.

[21] Appl. No.: 608,743

[22] Filed: Nov. 5, 1990

[51] Int. Cl.[5] ..... A47G 19/22

[52] U.S. Cl. ..... 248/346.1; 81/3.15; 7/151; 215/228; 220/212

[58] Field of Search ..... 248/346.1; 7/152, 151; 81/3.09, 3.15; 220/212, 285, 286; 215/778, 100.5

[56] References Cited

U.S. PATENT DOCUMENTS

| | | | |
|---|---|---|---|
| 821,208 | 5/1906 | Voss | 248/346.1 |
| 2,241,501 | 5/1941 | Bates | 215/228 X |
| 2,589,967 | 3/1952 | Sawyer | 215/100.5 |
| 2,612,287 | 9/1952 | Snook | 220/212 |
| 3,079,037 | 2/1963 | Schechfer | 215/100.5 X |
| 3,254,784 | 6/1966 | Lancesseur | 215/228 |
| 3,381,838 | 5/1968 | McClain et al. | 215/228 |
| 3,850,341 | 11/1974 | Bart | 215/228 X |
| 4,932,549 | 6/1990 | Gouttefangeas | 220/212 X |
| 4,978,848 | 5/1990 | Ballway | 215/228 X |

FOREIGN PATENT DOCUMENTS

| | | | |
|---|---|---|---|
| 220839 | 1/1990 | United Kingdom | 248/346.1 |

*Primary Examiner*—Alvin C. Chin-Shue

*Attorney, Agent, or Firm*—Longacre & White

[57] ABSTRACT

A multi-functional coaster has a vessel-supporting platform and extending from the periphery of the platform one or more additional constructional features enabling the coaster to be used also as a bottle opener and/or a sealing lid for a beverage can and/or a can opening tab lifter. The bottle opening feature is formed by a radial flange of claw-like cross-section and an axial skirt on which is provided a sharp-edged radially outwardly projecting portion for engaging the rim of a bottle cap. The flange simultaneously provides means for assisting leverage of a can tab by inserting it between the tab and the roof of the can, or alternatively a flange may be provided on its own for that purpose. The sealing lid feature is provided by a radially inwardly projecting step on the skirt, which forms a recess for releasably and sealingly engaging the lip on the top of a beverage can. This feature may be provided on its otwn on the skirt or in conjunction with the bottle opening feature. The whole coaster can be easily and cheaply molded from plastic. Optionally, the part of the skirt forming the cap rim-engaging part of the bottle opener is provided by a metal insert.

6 Claims, 6 Drawing Sheets

MULTI-FUNCTIONAL COASTER

FIELD OF THE INVENTION

This invention relates primarily to a coaster, namely a disk placed under a receptacle to protect a table-top or other surface beneath. The invention also relates to a tool for opening vessels such as bottles and beverage cans. The invention further relates to lids for vessels, particularly beverages cans.

BACKGROUND OF THE INVENTION

The use of a coaster for protecting a surface such as a table-top from drips, spillages, condensation or excessive hot or cold temperatures from, for example, beverage-containing receptacles is very well known. A typical example of this is in bars or restaurants, where beverages are consumed from a glass or a bottle which is placed on a coaster to protect the table-top or bar surface beneath it.

Conventional coasters are generally in the form of mats made of, for example, laminated cardboard, cork or other wood. These known coasters are cheap to produce and their thermal insulation properties are generally satisfactory. However, their lifetime is often short, owing mainly to inferior strength and low liquid resistance.

Further problems encountered by avid beverage drinkers and the people who supply or serve beverages in bars or restaurants arise from the various types of container in which beverages are packaged and sold. Each type of container generally has its unique means of opening. For example, beverage cans are normally opened using a ring pull or tab, whereas bottles, especially bottles containing carbonated or fermented beverages, are often fitted with crimped caps. Unfortunately, such opening means have a number of associated shortcomings:

Can tabs are often difficult to grasp and properly manipulate, for example owing to the ring pull being formed from particularly stiff metal or the consumer having fat or weak fingers and/or weak or excessively long or short fingernails. Beverage cans are also non-closable, so the whole contents must be consumed within a short time if it is not to deteriorate or go "flat" in the case of carbonated or other fizzy beverages. With regard to bottle caps of the crimped type, removal of the cap necessitates use of a special tool, which frequently has no other purpose other than for opening crimped bottle caps. In bars and restaurants this bottle opener is generally a fixed device mounted behind the bar so that bottles must generally be opened by the bar staff prior to being served to a customer. This ca sometimes be inconvenient, for example when a customer does not wish to consume his or her beverage at the time of purchase. It is also as impractical to supply each customer with their own special bottle opener with their purchase as it is unrealistic for consumers to carry their own bottle opener around with them for use as and when needed.

There are therefore several specific criteria, any number of which it would be desirable to be able to satisfy simultaneously with the provision of a coaster, for use by a consumer, namely:

functionality as a means of closure for beverage cans and similar vessels once they are opened;

functionality as a bottle opener, for use by a consumer as and when required;

functionality as a can tab lifter for assisting opening of a beverage can.

In other words, the lives of both beverage drinkers and people who supply or serve beverages could be made easier if there was available a single tool which could not only be used as a coaster but also function as a bottle opener and/or a can tab lifter and/or a can sealing lid. Such a tool would have to be readily available for use by a consumer as and when needed, wherever beverages are sold and/or consumed, and be comparable to conventional coasters in cost and ease of manufacture.

Such a tool has now been found.

SUMMARY OF THE INVENTION

Broadly, the present invention is a coaster for supporting a receptacle, including a platform and one or more additional constructional features enabling the coaster to function also as a bottle opener and/or a sealing lid and/or a can tab lifter.

Accordingly, in a first aspect the present invention provides a coaster for supporting a receptacle, which coaster includes a platform having a periphery and a surface for supporting the base of the receptacle, the platform defining an axial direction substantially perpendicular to its surface and a radial direction substantially perpendicular to the axial direction. The coaster further includes a skirt projecting generally axially from the platform periphery, the skirt including a radially inwardly projecting step along at least part of its length, to form a recess between the step and the platform for releasably and sealingly engaging a lip on the top of a vessel.

As used herein, the term "length" when applied to the skirt of the coaster means the length as measured along a path substantially parallel to the periphery of the platform.

The coaster according to this aspect of the invention can not only serve as a disk for placing beneath a vessel for protecting a table-top or other surface beneath, but it can also serve as a lid for closing and sealing an open beverage can or similar vessel. The step forms a recess between it and the platform, into which can be snap-fitted the lip of the top of a beverage can. The recess may or may not contain a sealing ring, e.g. of rubber or other elastomer, depending upon the degree of sealing provided by the material of the coaster itself. For example, a softer, more resilient coaster material (e.g. polypropylene) may obviate the need for an additional sealing ring, whereas a harder, less resilient coaster material (e.g. ABS or acetal resin) may necessitate a sealing ring in order to provide the necessary degree of sealing to prevent leakage of liquid or gas from the opened can. In order to improve the sealing capability of the coaster with the lip of the can, the recess between the step and the platform may be extended in an axial direction into the underside of the platform itself, so that the lip of the can is sealed on preferably all sides by the platform and the step. In order to assist the fitting of the coaster onto the lip of the can, at least one edge of the step spaced from the skirt, preferably the edge of the step distal from the platform, may be chamfered. Alternatively, the step may have a rounded profile. Clearly, the dimensions of the skirt and step must be such as to fit the dimensions of a can for which the coaster is intended for use as a lid. Fortunately, most beverage cans are a standard size, so that an appropriately dimensioned coaster can be used as a lid on cans containing a variety of different products. Use of the coaster according to this aspect of the invention as a lid is not limited to use on beverage cans; the coaster may be used on any type of container having a lip or protruding rim.

Materials which may be used to form the coaster are plastics, such as polypropylene, acetal resin (for example Delrin [trademark]), high density polyethylene (HDPE), ABS resin (acrylonitrile-butadiene-styrene copolymer) or even metal, e.g. steel, aluminium or alloys thereof. Any of the above mentioned materials may be used either alone or in combination and different parts of the coaster may even be formed of different materials.

The coaster of this aspect of the invention may be provided with a further constructional feature enabling it to function also as a can tab lifter. That feature is a flange projecting generally radially outwardly from the periphery of the platform for insertion between an opening tab and the roof of the can for assisting leverage of the tab when opening the can. Preferably, the flange has a thickness which decreases going from the periphery of the platform towards the radially outermost edge of the flange, which assists insertion of the flange between the opening tab and the roof of the can. Alternatively or additionally, the flange may be arcuate in cross-section, in the sense that its upper and lower surfaces are convex and concave, respectively. As well as improving the action of the can tab lifting feature of the coaster, these features of the flange may be useful for increasing the strength:weight ratio of the coaster.

The coaster according to this aspect of the invention is preferably circular, the platform being in the form of a circular disk. To provide enhanced utility, it is desirable that the skirt and flange, if present, are continuous around the periphery of the platform.

The coaster of this aspect of the invention may be formed using any suitable means, for example molding, machining or a combination of the two. Molding the complete coaster is most preferred, for reasons of simplicity and cost. An alternative method of forming the coaster is to provide a plurality of elements each of which comprises one or more constructional features of the coaster and bonding the elements together, for example by welding, adhesive or any other suitable means.

Thus, the first aspect of the invention further provides a method of forming a coaster for supporting a receptacle. The method comprises: (a) providing a first element which includes a platform having a periphery and a surface for supporting the base of the receptacle, the platform defining an axial direction substantially perpendicular to its surface and a radial direction substantially perpendicular to the axial direction; (b) providing a second element which includes a skirt extending generally axially (with respect to the platform of the first element), the skirt including along at least part of its length a step projecting radially inwardly therefrom (with respect to the platform of the first element); and (c) bonding together the first and second elements, so that a recess is formed between the step of the second element and the platform of the first element for releasably and sealingly engaging a lip on the top of a vessel, e.g. a beverage can.

This method of forming the coaster by bonding togethermultiple elements enables each element to be easily and cheaply molded individually, preferably each as an integral molding.

In order to form the embodiment of the coaster having a can tab-lifting flange extending radially outwardly from the periphery of the platform, that flange may be provided as part of the first element in the above method. Preferably, the flange is an integral part of the first element, but it can if desired be formed as a separate element and bonded to the first element at any stage of the method.

The platform of the coaster of this aspect of the invention provides an ideal site for the application of a design or logo, if desired. Any design, decoration, emblem, picture, photograph or mark (e.g. a trademark or service mark), may be applied, for example by printing, painting, stamping or the application of an adhesive label or sticker. Promotional logos, such as those of beverage manufacturers, with whose products the coasters of the invention may often be used, may be particularly desirable.

The platform of the coaster may optionally have formed in its surface one or more grooves to act as drainage channels for drips, leakages or condensation from the vessel placed on it. Desirably, a least one groove is provided around the periphery of the platform's surface, thereby leaving the central region free for the optional application of a logo or other decorative device.

In a second aspect the present invention provides a coaster for supporting a receptacle, which coaster includes a platform having a periphery and a surface for supporting the base of the receptacle, the platform defining an axial direction substantially perpendicular to its surface and a radial direction substantially perpendicular to the axial direction. The coaster further includes a flange projecting generally radially outwardly from the platform periphery, and a skirt projecting generally axially from the periphery. The skirt includes a radially outwardly projecting portion along at least part of its length and spaced from the platform. The flange and the radially outwardly projecting portion of the skirt are together engagable with a cap on a vessel and the cap is removable from the vessel by leverage of the coaster when the flange and the radially outwardly projecting portion are in engagement with the cap.

Thus, the coaster according to this aspect of the invention can not only serve as a coaster, but it can also serve as a bottle opener. In fact, the bottle opener feature of the coaster may be used to remove caps or lids from vessels other than bottles.

In order to assist engagement of the radially outwardly projecting portion of the skirt beneath a rim of a cap to be removed from a bottle, that portion is preferably bevelled so as to form a sharp (i.e. acutely angled) edge proximal to the flange. The radially outwardly projecting portion may, if desired, be provided along the total length of the skirt, in which case if the flange and the skirt itself are continuous around the periphery of the platform, then the bottle opener feature can be provided at all points around the coaster's perimeter, thereby giving enhanced utility. However, in a preferred embodiment the radially outwardly projecting portion is provided at a selected location or locations along the skirt, most preferably on a segment of the skirt, and is formed by a radially outwardly projecting portion of an insert fast with the skirt. The insert may be of metal, e.g. steel, aluminium or an alloy thereof, in order to give the bottle opener feature the necessary hardness and strength, which allows the remainder of the coaster, if desired, to be made of a softer, more resilient material than would otherwise be possible. An example of such a coaster material suitable for use with a metal insert is polypropylene. The insert is preferably attached to the skirt of the coaster by means of a portion of the insert integral with the radially outwardly projecting portion thereof being securably received in a recess formed between an inner and outer skirt portion of the above mentioned segment of the skirt. The insert may be secured in the recess by any suitable means, e.g. welding, adhesive or simply by friction between the insert and the inner walls of the recess. The insert may, if desired, be removable from the recess so as to allow replacement thereof as and when necessary. Preferably, however, since a metal insert will have a reasonably long working life, the insert includes one or more barbs on the portion integral with the radially outwardly projecting portion for engaging an inner wall or walls of the recess, so that the insert is non-removable therefrom. In an alternative embodiment, the radially outwardly projecting portion of the skirt is integral with the skirt, for example simply molded integrally therewith.

In the coaster of this aspect of the invention, the flange and the platform (including the surface thereof) are subject to the same optional modifications and additional features as have already been mentioned in respect of the embodiments of the coaster of the first aspect of the invention.

The coaster of this second aspect of the invention may be provided with a further constructional feature enabling it to function also as a sealing lid for a beverage can or similar vessel. This optional feature is analogous to the sealing lid feature which is an essential feature of the coaster of the first aspect of the invention, namely a radially inwardly projecting step along at least part of the length of the skirt, i.e. on the side of the skirt opposite to the radially outwardly projecting portion forming part of the bottle opener feature. This step forms, as before, a recess between it and the platform for releasably, sealingly engaging a lip of the vessel. This sealing lid feature is subject to the same optional modifications and additional features as have already been mentioned in respect of the analogous feature in the embodiments of the coaster of the first aspect of the invention.

It will be appreciated that the flange of the coaster of this second aspect of the invention which forms part of the bottle opener feature is analogous to the optional flange feature of the coaster of the first aspect of the invention and thus enables the coaster of this second aspect of the invention to be used also as a can tab lifter in the manner which was described earlier. Again, the flange is subject to the same optional modifications and additional features as were mentioned earlier in respect of the coaster of the first aspect of the invention.

The coaster according to this aspect of the invention may be formed in a number of ways. Molding or machining or a combination of the two are preferred. More particularly, when an insert is used to form the part of the skirt forming the bottle opener feature, the rest of the coaster is preferably formed as an integral molding, for reasons of ease and cheapness of manufacture. However, in embodiments where both the sealing lid and bottle opener features are required to be present, owing to practical difficulties in molding a double under-cut, a machining step can usefully be included to form one of those features, the blank to be machined being premolded to include all the remaining features of the coaster. In an alternative method analogous to the method of the first aspect of the invention, the coaster of this aspect of the invention may be constructed from multiple elements bonded together, each element providing one or more constructional features of the finished coaster. Thus, this second aspect of the invention further provides a method of forming a coaster for supporting a receptacle. The method comprises: (a) providing a first element which includes a platform having a periphery and a surface for supporting the base of the receptacle, the platform defining an axial direction substantially perpendicular to the surface and a radial direction substantially perpendicular to the axial direction, and further includes a flange projecting generally radially outwardly from the platform periphery; (b) providing a second element which includes a first skirt section extending generally axially (with respect to the platform of the first element), the first skirt section including along at least part of its length a portion projecting radially outwardly therefrom (with respect to the platform of the first element); and (c) bonding together the first and second elements, so that the radially outwardly projecting portion of the first skirt section of the second element is spaced from the platform of the first element, and the flange and the radially outwardly projecting portion of the first skirt section are together engagable with a cap on a vessel and the cap is removable from the vessel by leverage of the coaster when the flange and the radially outwardly projecting portion are in engagement with the cap.

To form the embodiment of the coaster comprising also the sealing lid feature, the above method further comprises: (d) providing a third element which includes a second skirt section extending generally axially (with respect to the platform of the first element), the second skirt section including along at least part of its length a step projecting radially inwardly therefrom (with respect to the platform of the first element); and (e) bonding the third element to the second element, so that a recess is formed between the step of the third element and the platform of the first element for releasably and sealingly engaging a lip on the top of a vessel.

The third element may be bonded to the first element as well as to the second, to provide a structure having increased strength. As before, use of this alternative method of forming the coaster allows each element to be easily and cheaply formed as an integral molding. Of course, where three elements are bonded together as in the above last mentioned method, the second element may alternatively be the one providing the sealing lid feature and the third element the one providing the bottle opening feature, the end result when all three elements are bonded together being the same as in the method recited above.

As in the method of forming the coaster of the first aspect of the invention, the flange of the coaster of the second aspect of the invention is preferably provided as an integral portion of the first element. Alternatively, the flange may be provided as a separate element bonded to the first element at any stage of the method.

In a third aspect of the present invention, there is provided a coaster for supporting a receptacle, which coaster includes a platform having a periphery and a surface for supporting the base of the receptacle, the platform defining an axial direction substantially perpendicular to its surface and a radial direction substantially perpendicular to the axial direction, and further includes a flange projecting generally radially outwardly from the platform periphery for insertion between an opening tab and the roof of a can for assisting leverage of the tab when opening the can.

Thus, the coaster of this aspect of the invention has a simpler structure than the coasters of the first and second aspects of the invention and has just one auxiliary use, namely as a can tab lifter. This coaster, in particular the platform (including the surface thereof) and the flange, is subject to the same optional modifications and additional features as have already been mentioned in respect of embodiments of the coasters of the first and second aspects of the invention.

BRIEF DESCRIPTION OF THE DRAWINGS

FIG. 7(*b*) is a cross-sectional view on arrows VIIb of FIG. 7(*a*);

FIG. 7(*c*) is a cross-sectional view on arrows VIIc of FIG. 7(*b*);

FIGS. 7(*d*), (*e*), and (*f*) are, respectively, front, side and top views of the insert for, inserting into the recess in the coaster of FIG. 7(*a*);

DETAILED DESCRIPTION OF PREFERRED EMBODIMENTS

The most preferred embodiment of the coaster of the invention is a coaster in accordance with the second aspect thereof, including the optional sealing lid feature. That is, the most preferred coaster is that which has all three auxiliary uses. The following detailed description is thus directed to this most preferred embodiment, but it will be appreciated that preferred coasters in accordance with the first and third aspects of the invention are analogous to the coasters described below with reference to the drawings but are provided with only certain of the disclosed and illustrated constructional features, as defined in the foregoing summary of the invention.

Figure 3:
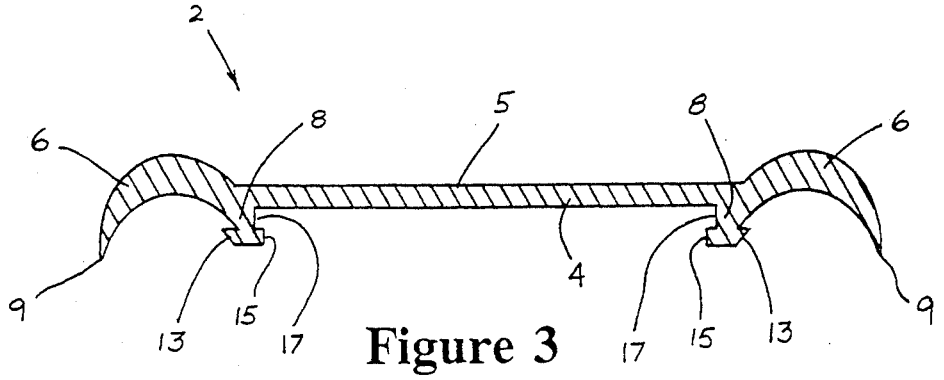
FIG. 3 is a diametric cross-sectional view of the embodiment.

Referring firstly to FIG. 3, coaster 2 comprises a circular platform 4 having an upper surface 5 for contacting and supporting the base of a vessel such as a glass, bottle or can. Projecting generally radially outwardly from the periphery of the platform 4 is a continuous flange 6 and projecting generally axially from the periphery is a continuous skirt 8.

The flange 6 has a substantially crescent-shaped cross-section, i.e. it has upper and lower surfaces which are convex and concave, respectively, and the thickness of the flange (measured by a straight line intersecting, and making equal angles with, both upper and lower surfaces) decreases in a direction from the periphery of the platform towards its radially outermost edge 9.

Figure 4:
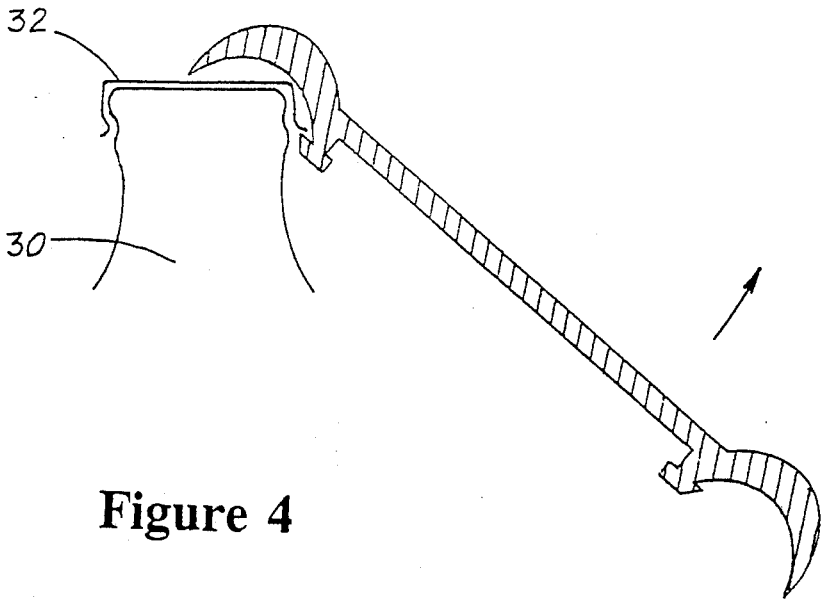
FIG. 4 is a part-cross-sectional view of the embodiment of FIG. 3 in engagement with a bottle cap.

The skirt 8 includes a bevelled radially outwardly projecting portion 13 which forms with the flange 6 a bottle-opening feature. This feature is illustrated more clearly in FIG. 4, which shows the coaster in engagement with a crimped cap 32 of a bottle 30. As illustrated, the flange 6 abuts the roof of the cap 32 and the sharp edge of the projecting portion 13 assists engagement of the portion 13 beneath the rim of the cap 32. As with a conventional bottle opener, the cap 32 is removed from the lip of the bottle 30 by leverage of the engaged coaster in an upward direction, as shown by the arrow in FIG. 4.

Figure 1:
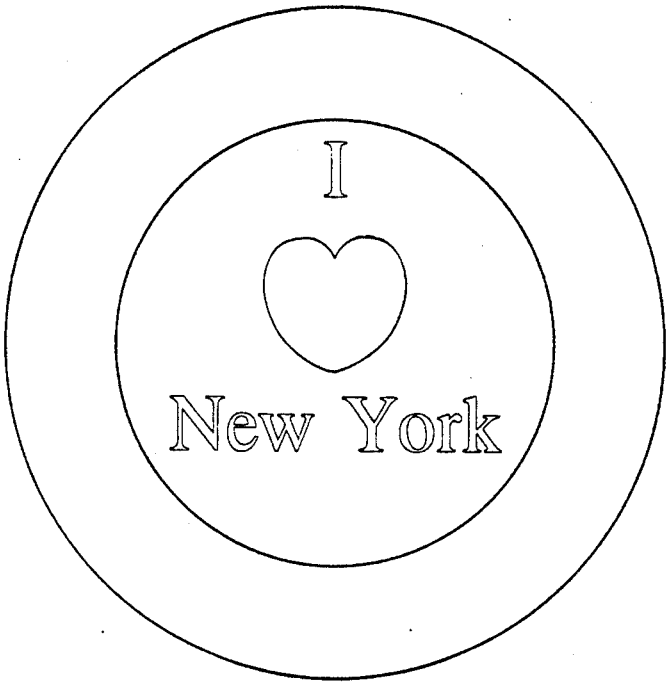
FIG. 1 is a top plan view of one preferred embodiment of the invention.
Figure 2:
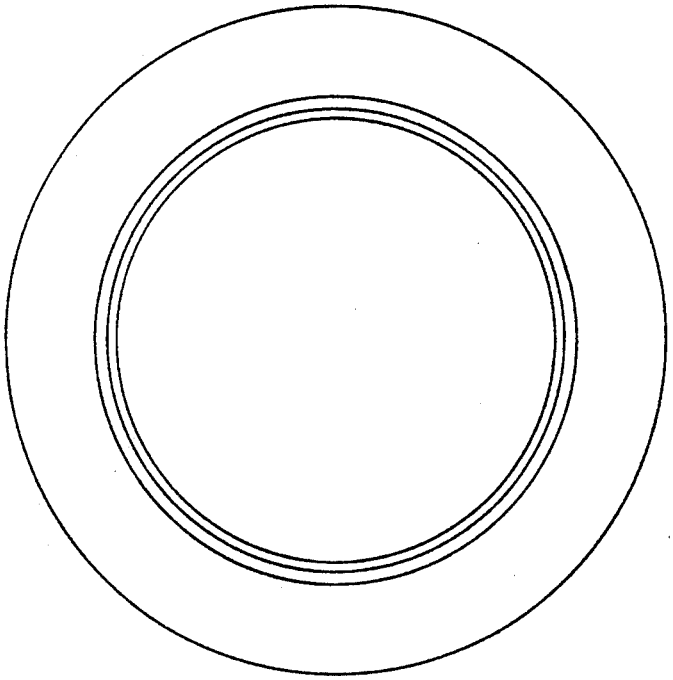
FIG. 2 is a bottom plan view of the embodiment.

The central area of the platform surface 5 of the coaster 2 has applied to it a logo or other design or decoration, an example of which is shown in FIG. 1.

Figure 5:
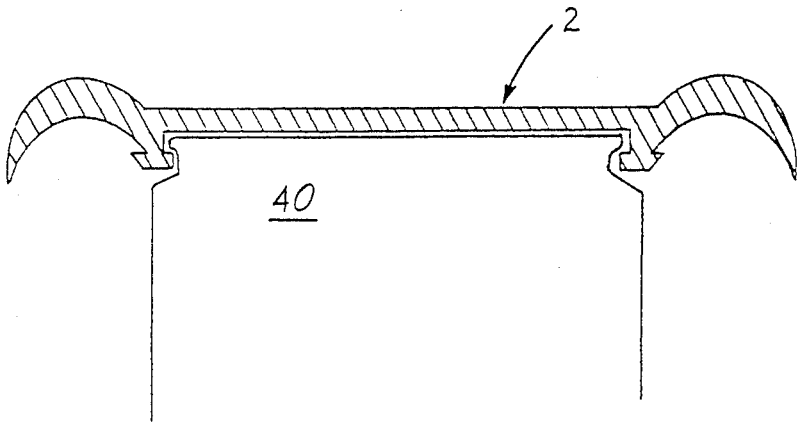
FIG. 5 is a part-cross-sectional view of the embodiment of FIG. 3 in place, on the top of a beverage can and forming a sealing lid therefor.
Figure 6:
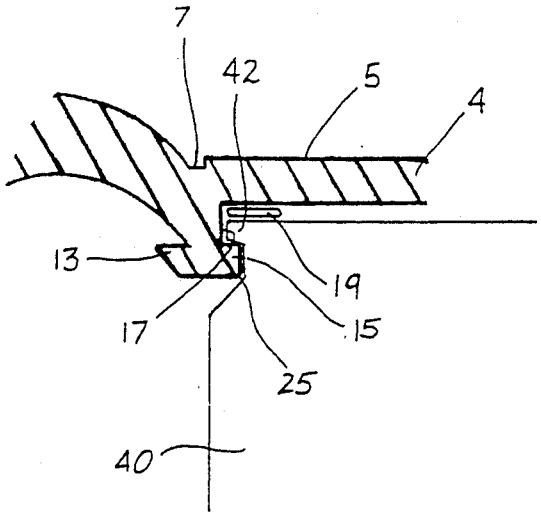
FIG. 6 is an enlarged view of a portion of FIG. 5.
Figure 7A:
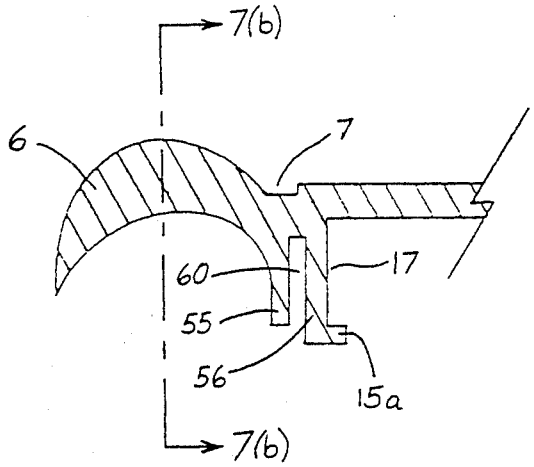
FIG. 7(*a*) is an enlarged, split view of a second preferred embodiment of the invention, in which the bottle-opening feature of the coaster is to be formed by a metal insert.
Figure 7A:
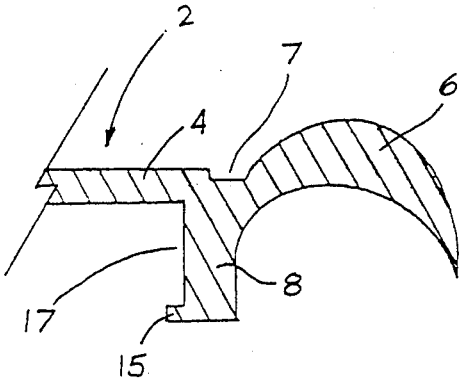
Figure 7B:
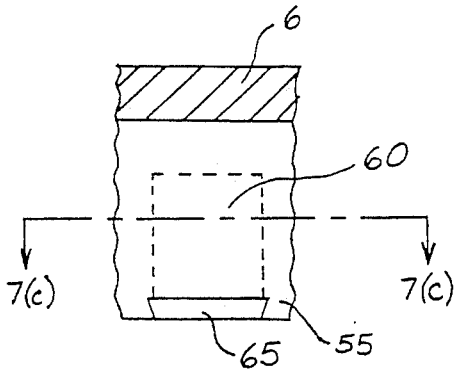
Figure 7C:
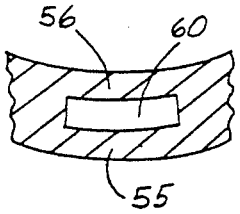
Figure 7D:
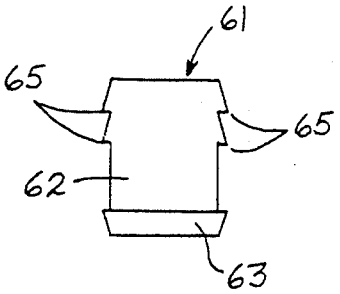
Figure 7E:
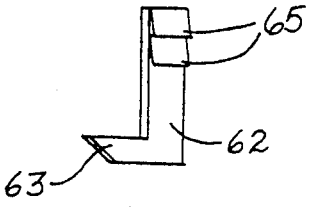
Figure 7F:
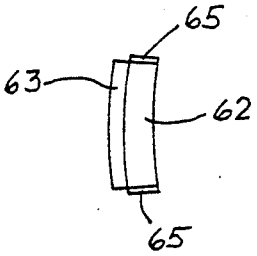

Referring back to FIG. 3, the opposite side of the skirt 8 from the projecting portion 13 is provided with a radially inwardly projecting step 15, forming a recess 17 between the step 15 and the platform 4. FIGS. 5 and 6 show the coaster 2 in position on the top of a beverage can 40, in which condition the coaster forms a lid which closes and seals an opening in the roof of the can. The coaster is snap-fitted onto the lip 42 of the can 40, by virtue of the resilience of the skirt 8. As shown in FIG. 6, the edge 25 of the projecting step 15 distal from the platform 4 is chamfered, in order to assist location and snap-fitting of the coaster onto the lip 42 of the can 40. The opposite edge of the step may be similarly chamfered, or the step may have a rounded profile, in order to improve the sealing contact between the recess 17 and the lip 42 and/or to assist disengagement of the coaster from the top of the can. FIG. 6 also shows an annular sealing ring 19 provided in the recess 17. Alternative forms of sealing ring may be used, as desired. For example, a sealing ring in the form of a cylinder or a torus, rather than an annulus, may be used.

Also shown in FIG. 6 is the optional feature of an annular groove 7 formed in the upper surface 5 of the platform 4. The groove 7 acts as a drainage channel, so that drips, spillages or condensation do not collect on the central area of the platform surface on which a vessel is to be placed when the coaster is in use.

Figure 11:
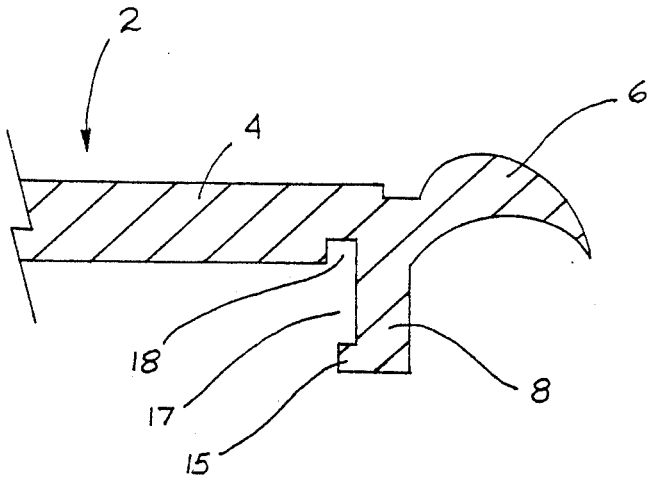
FIG. 11 is an enlarged view of part of FIG. 7(*a*), showing a variation in the shape of the recess formed between the step and the platform.

As shown in FIG. 11, the recess 17 between the step 15 and the platform 4 may be extended into the underside of the platform 4 by virtue of additional recess 18, which is preferably shaped to fit the upper part of the beverage can lip which is received therein when the coaster is fitted on the can. This feature improves the sealing ability of the coaster when used as a lid for a vessel such as a beverage can with an upwardly protruding lip.

The whole coaster 2 is molded from a hard plastic, such as acetal resin (e.g. Delrin [trademark]). However, due to possible molding difficulties, one or other or both of the radially outwardly projecting portion 13 and the radially inwardly projecting step 15 of the skirt may be formed by carrying out a machining step on a blank which has been pre-molded.

In an alternative embodiment of the coaster of this aspect of the invention, as shown in FIGS. 7(*a*)–(*f*), the projecting portion 13 is provided on just a segment of the skirt, e.g. a segment subtending an angle at the center of the coaster in the range 5–40 degrees. As shown in FIG. 7(*a*), the coaster 2 comprises platform 4 and continuous radial flange 6 and axial skirt 8, as before, but now the skirt 8 has a cross-section over a major part of its length corresponding to that shown in the right hand half of the FIG., i.e. the skirt 8 has no radially outwardly projecting portion protruding from its radially outer surface, but has only the radially inwardly projecting step 15 which, as before, forms the sealing lid feature. The segment of the skirt 8 which in this embodiment provides the bottle-opening feature is seen more clearly in the left hand half of FIG. 7(*a*), FIG. 7(*b*) and FIG. 7(*c*). This segment of the skirt 8 is split into an outer skirt portion 55 and an inner skirt portion 56, with a recess 60 formed therebetween. The inner skirt portion 56 is provided with a radially inwardly projecting step portion 15*a* which is of the same shape and dimensions as and contiguous with the corresponding step 15 formed on the remainder of the skirt 8. FIGS. 7(*d*), (*e*) and (*f*) show a preferred insert which is used to generate the bottle-opening feature of the coaster. The insert 61, e.g. of metal such as hard steel, comprises a primary portion 62 and a secondary portion 63 integral therewith and substantially perpendicular thereto. The secondary portion 63 has a profile which is substantially identical to the radially outwardly projecting portion 13 of the embodiment of FIG. 3, so that when the coaster is fully assembled, both embodiments have a bottle-opening feature of approximately the same configuration. The primary portion 62 of the insert 61 is shaped and dimensioned so as to fit snugly into the recess 60 formed in the segment of the skirt 8. The insert 61 may be secured in the recess 60 by any suitable means, but preferably this is by virtue of one or more barbs 65 on each side of the insert which engage and embed themselves in the inner walls of the recess 60 as the insert 61 is pushed into place therein. Thus, once the insert 61 is in place, it cannot be removed. However, if desired the barbs may be omitted and other suitable securing means may be used, e.g. pins or rivets, in order to make easy replacement of the insert possible, for example when one insert reaches the end of its useful life. Since in this embodiment the critical high strength and hardness properties of the bottle-opening feature of the coaster are provided by just the insert 61 and not the whole of the skirt 8, the parts of the skirt formed as an integral part of the coaster may be made of a material which is softer and more resilient than would otherwise be possible, e.g. polypropylene. This may have advantages as regards ease and cost of manufacture.

Figure 8:
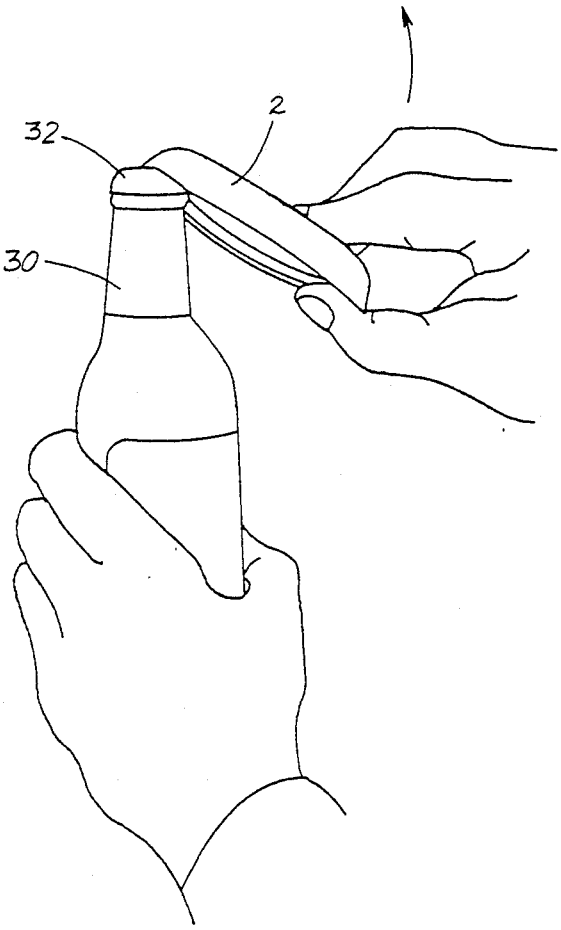
FIG. 8 is a perspective view of the embodiment of FIG. 3 or FIG. 7(*a*) in use as a bottle opener.

FIG. 8 further illustrates the use of the coaster 2 of FIG. 3 or FIG. 7 as a bottle opener for removing a crimped cap 32 from the neck of a bottle 30. Leverage of the coaster 2 is applied in a direction as shown by the arrow in the FIG. Obviously, when the coaster is that shown in FIG. 7, it is necessary to orient the coaster correctly before engaging it with the cap 32, so that it is the segment of the skirt having the bottle-opening insert which is engaged with the cap.

Figure 9:
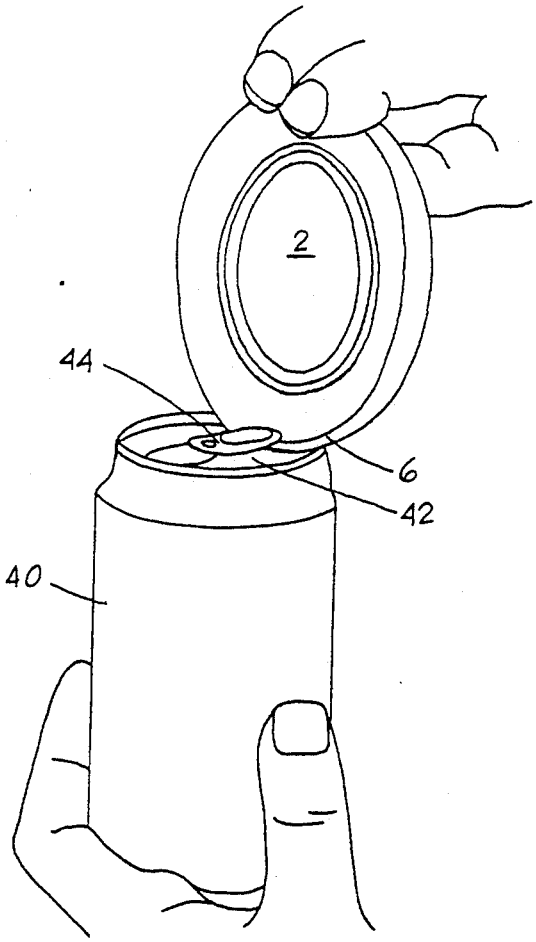
FIG. 9 is a perspective view of the embodiment of FIG. 3 or FIG. 7(*a*) in use as a can tab lifter.

FIG. 9 illustrates the use of the coaster 2 as a can tab lifter for assisting leverage of a can tab 44 for the purpose of opening a beverage can 40. The flange 6 of the coaster 2 is inserted between the can tab 44 and the roof 42 of the can 40 and leverage is applied to the coaster and/or the coaster is pulled in a generally upward direction so as to pop the opening tab and thereby open the can.

Figure 10:
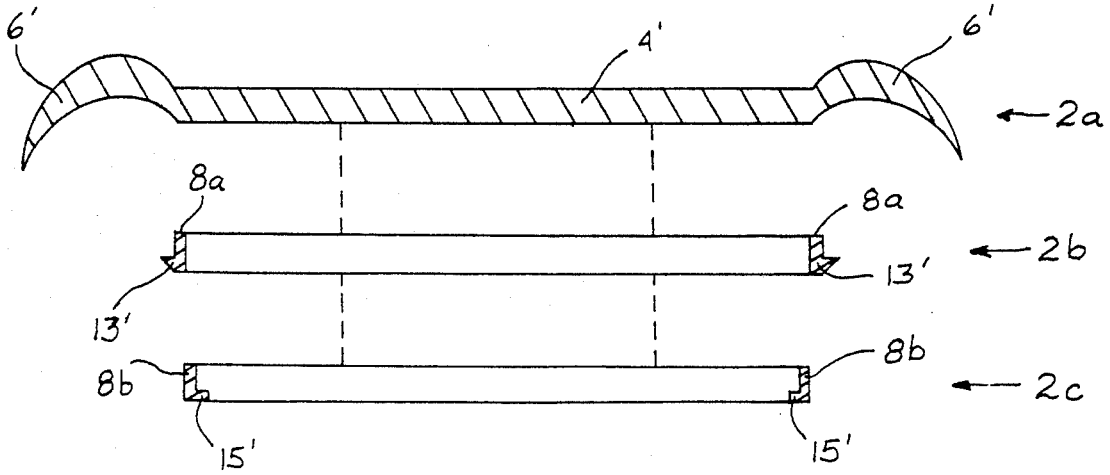
FIG. 10 is an enlarged exploded cross-sectional view of a three element combination for forming the embodiment of FIG. 3.

FIG. 10 shows in exploded form three elements for bonding together to form the coaster of FIG. 3. A first element 2*a* comprises platform 4' and continuous, integral flange 6' extending generally radially outwardly from the periphery thereof. A second element 2*b* is in the form of a cylindrical sleeve comprising first skirt section 8*a* which includes radially outwardly projecting portion 13'. A third element 2*c* is also in the form of a cylindrical sleeve and comprises second skirt section 8*b* which includes radially inwardly projecting step 15' along the total length thereof. The three elements 2*a*, 2*b*, 2*c* are bonded together, with first skirt section 8*a* of element 2*b* adjacent platform 4' of element 2*a*, and element 2*c* inserted inside element 2*b* so that second skirt section 8*b* is adjacent and bonded to first skirt section 8*a* and a recess is formed between step 15' and platform 4'. (Second skirt section 8*b* may be bonded also to platform 4', if desired, to give improved strength.)

In an alternative configuration of the three elements of FIG. 10, elements 2*b* and 2*c* are reversed, so that it is the "middle" element that carries the radially inwardly projecting step 15' and the "lower" element that carries the radially outwardly projecting portion 13'.

The three elements 2*a*, 2*b*, 2*c* are molded from a plastics material such as ABS resin or high density polyethylene. The three elements do not necessarily have to be of the same material — physical properties such as hardness, resilience and strength of the various constructional features of the coaster may be selected and adjusted by forming the respective elements from appropriate materials. For example, elements 2*a* and 2*b* may be formed of a hard plastic such as ABS resin, since the bottle opening feature of the coaster necessitates a particularly hard, strong material, whereas element 2*c* may be formed of a softer, more resilient material such as high density polyethylene, since the sealing lid feature benefits from such physical properties.

The coaster of the embodiment of FIG. 7 may be formed using the same principle as shown in FIG. 10, by simply omitting element 2*b* (since the continuous radially outwardly projecting portion 13' is no longer required) and modifying a segment of the skirt portion 8*b* of element 2*c* so that it has a cross-section as shown in the left hand half of FIG. 7(*a*). An insert can then be inserted into the recess thus formed in the skirt, as has already been described with respect to FIG. 7, to form the complete coaster.

By way of example, a preferred coaster in accordance with the first aspect of the present invention takes the form illustrated in and described with reference to the right hand half of FIG. 7(*a*). In other words, the whole of the skirt 8 has a cross-section as shown in that half of that FIG. and includes only the inwardly projecting step 15 forming the sealing lid feature. The flange 6, which is optional in this embodiment, forms the can tab lifting feature of the coaster. A preferred coaster in accordance with the third aspect of the present invention takes the form of the upper element 2*a* shown in FIG. 10.

What is claimed is:

1. A coaster for supporting a receptacle, said coaster comprising:

a platform having a periphery and a surface for supporting the base of said receptacle, said platform defining an axial direction substantially perpendicular to said surface and a radial direction substantially perpendicular to said axial direction;

a flange projecting generally radially outwardly from said periphery; and a skirt projecting generally axially from said periphery, said skirt including a radially outwardly projecting portion along at least part of its length and spaced from said platform, said radially outwardly projecting portion of said skirt is formed on a segment of said skirt by a radially outwardly projecting portion of an insert fast with said skirt, wherein said flange and said radially outwardly projecting portion of said skirt are together engagable with a cap on a vessel and said cap is removable from said vessel by leverage of said coaster when said flange and said radially outwardly projecting portion are in engagement with said cap.

2. A coaster according to claim 1, wherein said insert is of metal.

3. A coaster according to claim 1, wherein said segment of said skirt comprises an inner skirt portion and an outer skirt portion, said inner and outer skirt portions defining a recess therebetween and a portion of said insert integral with said radially outwardly projecting portion thereof is securably received in said recess.

4. A coaster according to claim 3, wherein said portion of said insert integral with said radially outwardly projecting portion thereof includes at least one barb for engaging a respective inner wall of said recess, for non-removably securing said insert in said recess.

5. A coaster for supporting a receptacle, said coaster comprising:

a platform having a periphery and a surface for supporting the base of said receptacle, said platform defining an axial direction substantially perpendicular to said surface and a radial direction substantially perpendicular to said axial direction;

a flange projecting generally radially outwardly from said periphery;

a skirt projecting generally axially from said periphery, said skirt including a radially outwardly projecting portion along at least part of its length and spaced from said platform, and a radially inwardly projecting step along at least part of its length, to form a recess between said step and said platform for releasably and sealingly engaging a lip on the top of a vessel, a sealing ring provided in said recess formed between said step and said platform;

wherein said flange and said radially outwardly projecting portion of said skirt are together engagable with a cap on a vessel and said cap is removable from said vessel by leverage of said coaster when said flange and said radially outwardly projecting portion are in engagement with said cap.

6. A coaster for supporting a receptacle, said coaster comprising:

a platform having a periphery and a surface for supporting the base of said receptacle, said platform defining an axial direction substantially perpendicular to said surface and a radial direction substantially perpendicular to said axial direction;

a flange projecting generally radially outwardly from said periphery having a thickness which decreases in a radially outward direction; and a skirt projecting generally axially from said periphery, said skirt including a radially outwardly projecting portion along at least part of its length and spaced from said platform, wherein said flange and said radially outwardly projecting portion of said skirt are together engagable with a cap on a vessel and said cap is removable from said vessel by leverage of said coaster when said flange and said radially outwardly projecting portion are in engagement with said cap.

* * * * *